US008745993B2

(12) United States Patent
Lee et al.

(10) Patent No.: US 8,745,993 B2
(45) Date of Patent: Jun. 10, 2014

(54) REFRIGERATING APPARATUS AND METHOD OF CONTROLLING THE SAME

(75) Inventors: Sang Hoon Lee, Yeoju-gun (KR); Ji Young Lee, Yongin-si (KR); Masatoshi Inatani, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 964 days.

(21) Appl. No.: 12/801,022

(22) Filed: May 17, 2010

(65) Prior Publication Data

US 2010/0332048 A1 Dec. 30, 2010

(30) Foreign Application Priority Data

Jun. 29, 2009 (KR) ..... 10-2009-0058127

(51) Int. Cl.
*F25D 25/00* (2006.01)

(52) U.S. Cl.
USPC ..... 62/65; 62/62; 426/524

(58) Field of Classification Search
USPC ..... 62/62, 65, 125, 126, 129, 157, 158, 62/231; 426/524
See application file for complete search history.

(56) References Cited

U.S. PATENT DOCUMENTS 4,800,098 A * 1/1989 Galland ..... 426/637
5,244,674 A * 9/1993 Cadas et al. ..... 426/524
8,042,355 B2 * 10/2011 Cur et al. ..... 62/441
2005/0136161 A1 * 6/2005 Okita ..... 426/393
2006/0242975 A1 * 11/2006 Furlanetto et al. ..... 62/209
2008/0156031 A1 7/2008 Cur et al.

FOREIGN PATENT DOCUMENTS

| | | |
|---|---|---|
| CN | 1197917 A | 11/1998 |
| JP | 2003-180314 | 7/2003 |
| JP | 2006-97965 | 4/2006 |
| KR | 10-0756712 | 8/2007 |
| KR | 10-0780008 | 11/2007 |

OTHER PUBLICATIONS

Chinese Office Action mailed Oct. 12, 2013 in related Chinese Application No. 201010202418.2.

* cited by examiner

*Primary Examiner* — Cheryl J Tyler
*Assistant Examiner* — Jonathan Bradford
(74) *Attorney, Agent, or Firm* — Staas & Halsey LLP

(57) ABSTRACT

Disclosed herein are a refrigerating apparatus and a method of controlling the same. The method includes lowering a temperature in a storage chamber to a freezing point temperature zone by adjusting cold air supplied to the storage chamber, and lowering the temperature in the storage chamber to a temperature below a freezing point by increasing an amount of the cold air supplied to the storage chamber, when it is determined that a temperature of articles stored in the storage chamber is stabilized in the freezing point temperature zone by the cold air. When the surface temperature and the center temperature of the stored articles are cooled close to the freezing point and are then cooled again to the freezing temperature below the freezing point, super-cooling of the stored articles is carried out for a short time, the surfaces and the centers of the stored articles start to freeze simultaneously.

20 Claims, 13 Drawing Sheets

PRIOR ART

PRIOR ART

PRIOR ART

REFRIGERATING APPARATUS AND METHOD OF CONTROLLING THE SAME

CROSS-REFERENCE TO RELATED APPLICATIONS

This application claims the benefit of Korean Patent Application No. 2009-0058127, filed on Jun. 29, 2009 in the Korean Intellectual Property Office, the disclosure of which is incorporated herein by reference.

BACKGROUND

1. Field

The embodiments relate to a refrigerating apparatus, which improves freezing quality of stored articles, and a method of controlling the same.

2. Description of the Related Art

A refrigerating apparatus is an apparatus, in which the temperature of the inside of a sealed storage chamber is set to be lower than the external temperature, to store articles for a long time. The inside of the refrigerating apparatus is refrigerated by cold air generated by absorption of surrounding heat by a refrigerant when the refrigerant in a liquid state is evaporated in a refrigerating cycle, through which the refrigerant is circulated, and the stored articles are refrigerated through the refrigeration of the inside of the refrigerating apparatus.

In such a refrigerating apparatus, as shown in FIG. 1, an article stored in a storage chamber is refrigerated by the refrigerating cycle, through which the storage chamber is cooled to a temperature of −20° C. Here, a large difference between surface and center temperatures of the article stored in the storage chamber is generated, and freezing temperatures (i.e., freezing times) of the surface and the center of the stored article differ from each other. Thereby, ice crystals grow from the surface of the stored article to the center of the stored article. The closer to the center of the article, the more cells of the stored article are destroyed. Further, the temperature of the center of the article is raised again to the freezing point as phase change from moisture to ice at the center of the stored article occurs, and thus the time to lower the temperature of the center of the stored article is extended. Thereby, the stored article remains in a maximum ice crystal formation zone a1 for a long time a2, and thus large ice crystals or needle-shaped ice crystals are generated and the generated ice crystals destroy the cells of the stored article and lower the quality of the stored article. Accordingly, the stored article, such as animal and bird meat or fish, contains many drips after thawing, and loses much of its nutritional value, thus becoming unpleasant to taste.

In order to solve the above problem, the conventional refrigerating apparatus controls the temperature of the storage chamber using a refrigerating cycle using super-cooling, as shown in FIGS. 2A and 2B, to refrigerate a stored article. That is, cold air supplied to the storage chamber is set to a temperature of −5° C. for a designated time b2 such that the stored article is super-cooled at a designated temperature. When the designated time b2 has passed, the cold air supplied to the storage chamber is set to a temperature of −20° C. or less such that the super-cooling of the stored article is terminated, thereby starting simultaneous freezing of the surface and the center of the article, and thus reducing the size of ice crystals of the article. Since when the article is super-cooled, super-cooling may be terminated before the article reaches a designated temperature for the designated time b2, maintenance of the super-cooling of the article is difficult. Further, when the super-cooling of the article is terminated, the article remains in a maximum ice crystal formation zone b1 for a long time, and large ice crystals are formed in the article during this time, thus lowering the quality of the article. Moreover, when many articles to be stored are collected in the same container, the respective articles may be frozen at different points in time, and thus have different freezing qualities.

SUMMARY

Accordingly, it is an aspect of the embodiment to provide a refrigerating apparatus, which improves freezing quality of stored articles, and a method of controlling the same.

Additional aspects will be set forth in part in the description which follows and, in part, will be apparent from the description, or may be learned by practice of the disclosure.

The foregoing and/or other aspects are achieved by providing a method of controlling a refrigerating apparatus, the method including lowering a temperature in a storage chamber of the refrigerating apparatus to a freezing point temperature zone, including adjusting cold air supplied to the storage chamber, determining whether a temperature of articles stored in the storage chamber is stabilized in the freezing point temperature zone, lowering the temperature in the storage chamber to a temperature below a freezing point, including increasing an amount of the cold air supplied to the storage chamber, when it is determined that the temperature of articles stored in the storage chamber is stabilized in the freezing point temperature zone.

The determination as to whether or not the temperature of the articles stored in the storage chamber is stabilized in the freezing point temperature zone may include determining whether or not the temperature in the storage chamber is maintained within the freezing point temperature zone for a designated time.

The adjusting of the cold air may include adjusting at least one of an amount of the cold air and a direction of the cold air supplied to the storage chamber.

The lowering of the temperature in the storage chamber to the temperature below the freezing point may generate phase change of the stored articles stabilized in the freezing point temperature zone to freeze the stored articles.

The method may further include maintaining the temperature in the storage chamber at a preserving temperature by decreasing the amount of the cold air supplied to the storage chamber, when the freezing of stored articles is completed.

The preserving temperature may be a temperature between the temperature of the freezing point and the temperature below the freezing point.

The foregoing and/or other aspects are achieved by providing a method of controlling a refrigerating apparatus including maintaining a temperature in a storage chamber at a freezing point temperature zone for a first designated time, including supplying cold air to the storage chamber such that a temperature of articles stored in the freezing chamber is in the freezing point temperature zone, and maintaining the temperature in the storage chamber at a temperature below a freezing point for a second designated time including adjusting the cold air, when the first designated time has passed.

The first designated time may be a time to cool centers as well as surfaces of the articles stored in the storage chamber to the temperature of the freezing point, and the second designated time may be a time to freeze the stored articles.

The method may further include maintaining the temperature in the storage chamber at a preserving temperature by adjusting the cold air, when the second designated time has passed.

The adjusting of the cold air may include adjusting at least one of an amount of the cold air and a direction of the cold air supplied to the storage chamber.

The temperature below the freezing point may be a temperature, at which phase change of the stored articles occurs.

The foregoing and/or other aspects are achieved by providing a method of controlling a refrigerating apparatus including lowering a temperature in a storage chamber to a freezing point temperature zone comprising supplying cold air to the storage chamber, sensing a temperature of articles stored in the storage chamber, determining whether or not the temperature of the stored articles is maintained within the freezing point temperature zone, and lowering the temperature in the storage chamber to a temperature below a freezing point, including adjusting the cold air, when it is determined that the temperature of the stored articles is maintained within the freezing point temperature zone.

The determining whether or not the temperature of the stored articles is maintained within the freezing point temperature zone may include sensing the temperature in the storage chamber, and determining whether or not the temperature in the storage chamber is maintained within the freezing point temperature zone.

The method may further include determining whether or not the temperature of the stored articles is maintained within the freezing point temperature zone for a designated time.

The foregoing and/or other aspects are achieved by providing a refrigerating apparatus including a storage chamber to store articles, an internal temperature sensing unit to sense a temperature in the storage chamber, a plurality of refrigerating units to adjust cold air supplied to the storage chamber, and a control unit controlling the refrigerating units to lower a temperature in the storage chamber to a freezing point temperature zone, and lower the temperature in the storage chamber to a temperature below a freezing point, when a temperature of articles stored in the storage chamber is maintained within the freezing point temperature zone.

The control unit may maintain the temperature in the storage chamber within the freezing point temperature zone for a designated time.

The refrigerating apparatus may further include a surface temperature sensing unit to sense a surface temperature of the stored articles, and the control unit may determine whether or not the temperature in the storage chamber and the surface temperature of the stored articles are maintained within the freezing point temperature zone in the lowering of the temperature in the storage chamber to the freezing point temperature zone.

The refrigerant units may include dampers formed on respective wall surfaces of the storage chamber to open and close discharge holes, through which the cold air is discharged, and a fan to adjust a supply amount of the cold air.

The temperature below the freezing point may be a temperature, at which phase change of the stored articles occurs.

The control unit may control the refrigerating units to maintain the storage chamber at a preserving temperature, when the freezing of stored articles is completed.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
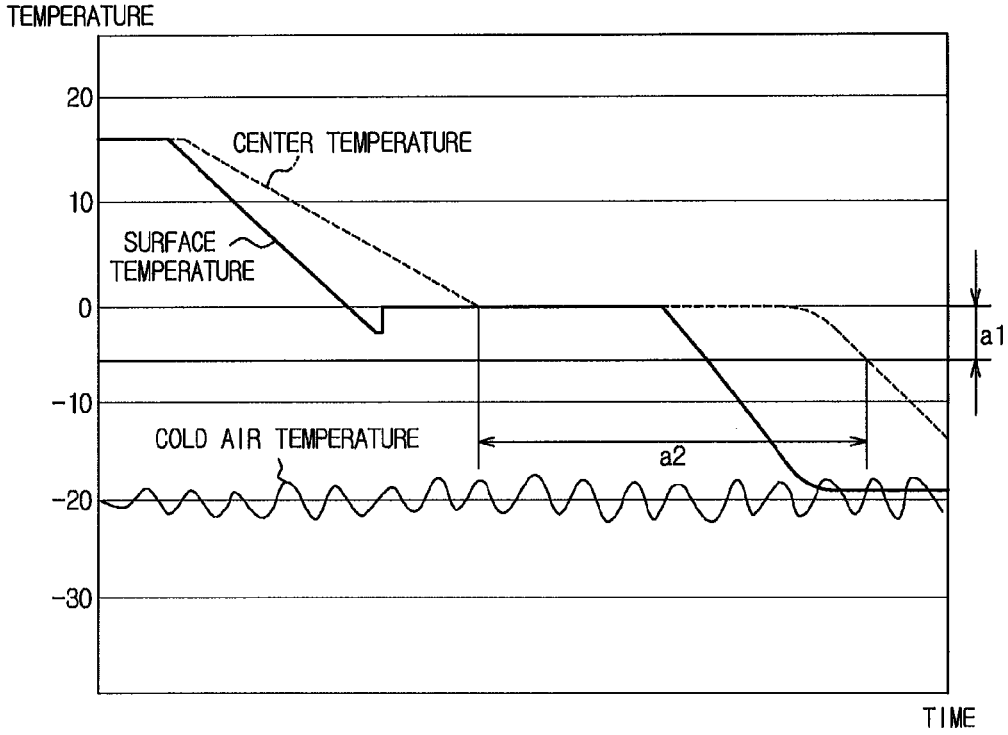
FIG. 1 is a graph illustrating control of refrigeration of a conventional refrigerating apparatus by a general refrigerating cycle.
Figure 2A:
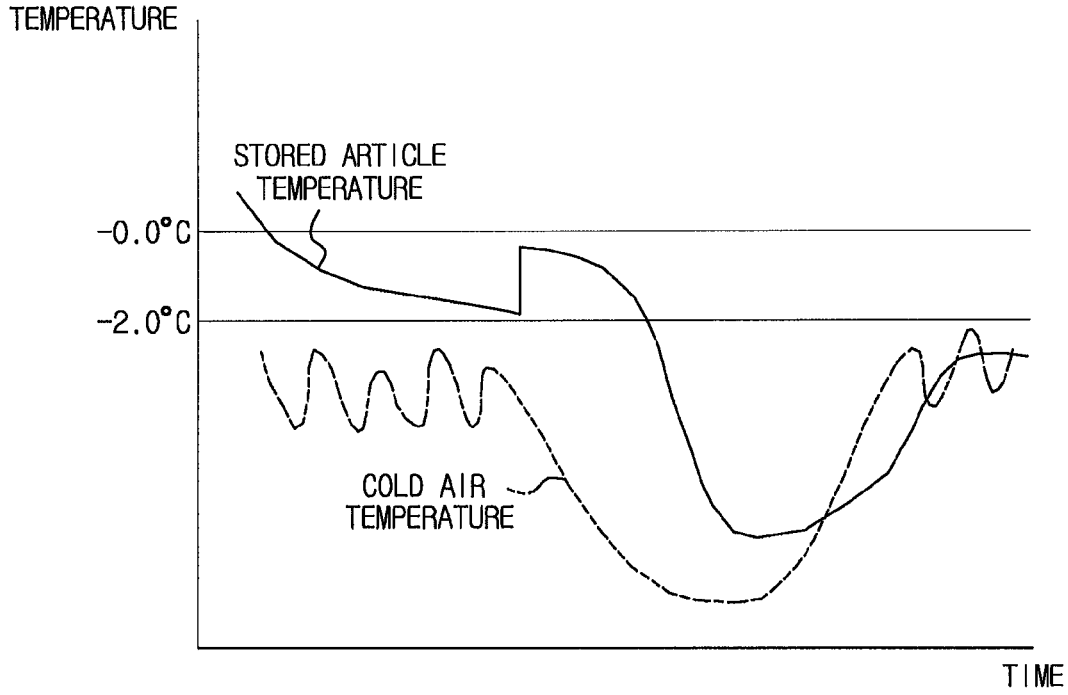
FIGS. 2A and 2B are graphs illustrating control of refrigeration of the conventional refrigerating apparatus by a supercooling cycle.
Figure 2B:
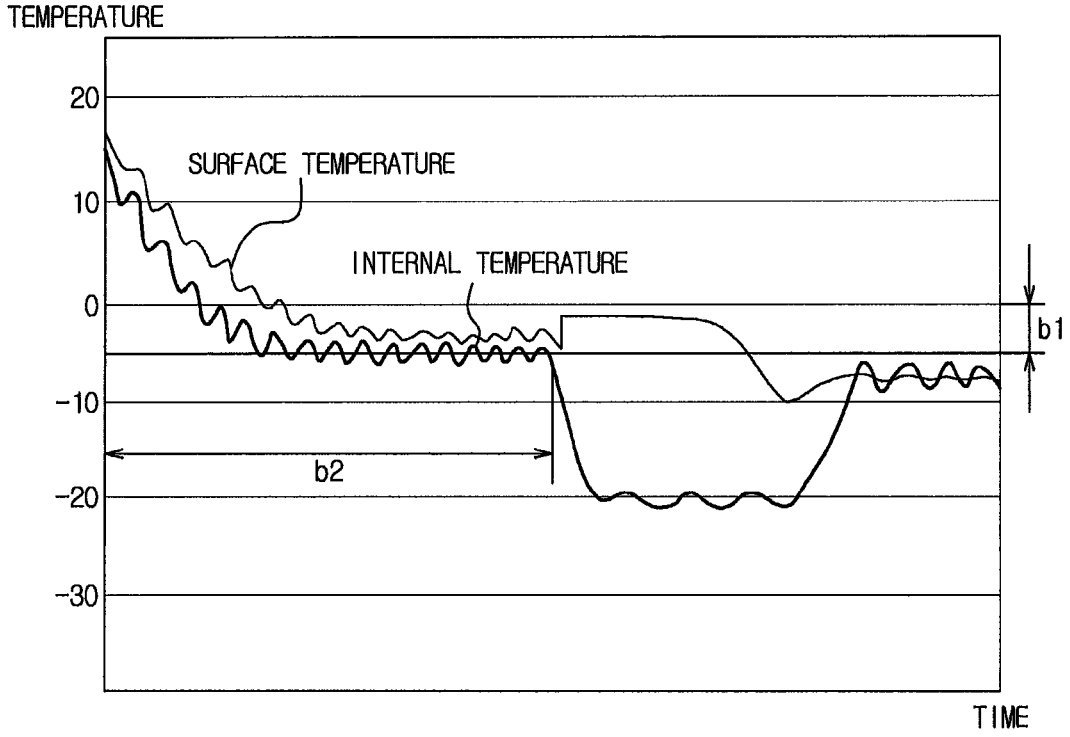

Reference will now be made in detail to the embodiment, examples of which are illustrated in the accompanying drawings, wherein like reference numerals refer to like elements throughout.

Figure 3:
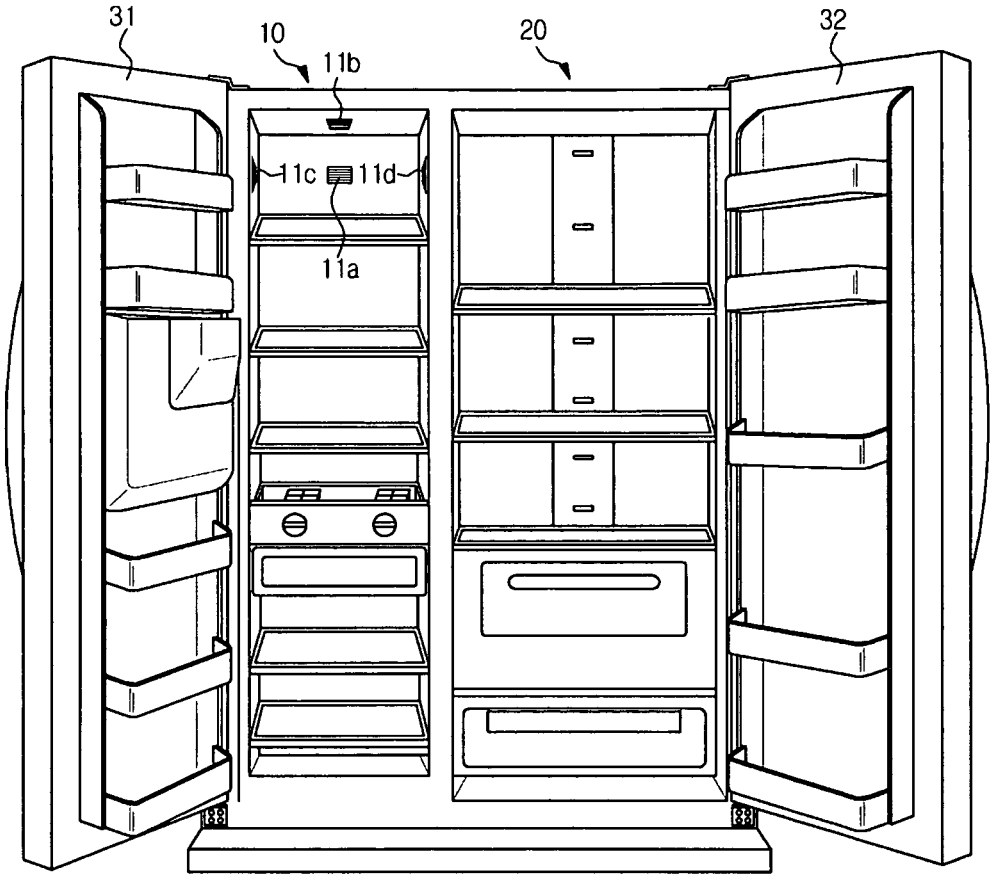
FIG. 3 is an exemplary view of a refrigerating apparatus in accordance with one embodiment.

FIG. 3 is an exemplary view of a refrigerating apparatus in accordance with one embodiment. As the refrigerating apparatus in accordance with this embodiment, a freezing chamber of a refrigerator will be exemplarily described.

The refrigerator includes a main body provided with an opened front surface, and storage chambers provided in the main body to store articles for a long time. The storage chambers are horizontally divided by a diaphragm. That is, the storage chambers include a freezing chamber 10 to store articles in a frozen state, and a refrigerating chamber 20 to store articles in a cold (but not frozen) state.

Front surfaces of the freezing chamber 10 and the refrigerating chamber 20 are opened, and doors 31 and 32 to shield the freezing chamber 10 and the refrigerating chamber 20 from the outside are respectively provided at the opened front surfaces of the freezing chamber 10 and the refrigerating chamber 20. Here, the doors 31 and 32 of the freezing chamber 10 and the refrigerating chamber 20 are selectively opened and closed.

Internal reception parts to receive various articles to be stored are detachably provided in multiple stages on the inner walls of the freezing chamber 10 and the refrigerating chamber 20 of the refrigerator, and door reception parts to receive articles to be stored are provided on the rear surfaces of the doors 31 and 32.

Figure 4:
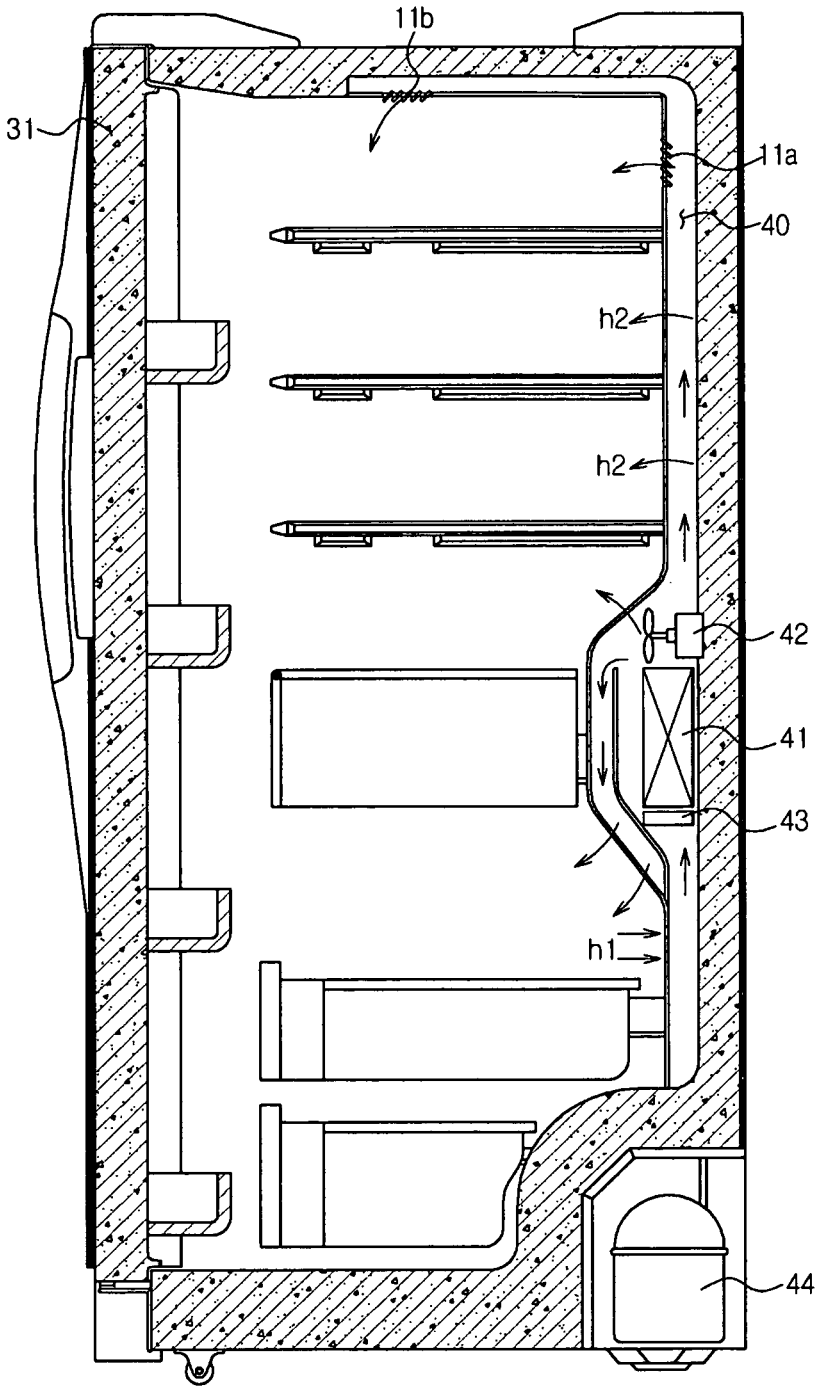
FIG. 4 is a longitudinal-sectional view of the refrigerating apparatus in accordance with the embodiment.

FIG. 4 is a longitudinal-sectional view of the refrigerating apparatus in accordance with the embodiment, i.e., a freezing chamber of a refrigerator.

A duct 40, through which cold air flows, is formed in a space between the freezing chamber 10 and the main body, a plurality of suction holes h1 serving as paths, through which the cold air in the freezing chamber 10 is transferred to the duct 40, and a plurality of discharge holes h2 serving as paths, through which the cold air in the duct 40 is transferred to the freezing chamber 10, are formed through at least one wall surface of the freezing chamber 10. Further, dampers 11*a* to 11*d* to open and close the discharge holes h2 are installed on the respective wall surfaces of the freezing chamber 10.

An evaporator 41 to cool surrounding air due to a cooling action, which absorbs surrounding latent heat while evaporating a refrigerant, a fan 42 to absorb the cold air in the freezing chamber 10 and blow the cold air having passed through the evaporator 41 to the freezing chamber 10, and a defrosting heater 43 to remove frost formed on the evaporator 41 are provided in a duct space formed in the duct 40 of the refrigerator. Further, a compressor 44 to compress the refrigerant, and a condenser (not shown) to condense the refrigerant in a high-temperature and high-pressure state compressed by the compressor 44 through heat dissipation and transfer the condensed refrigerant to the evaporator 41 are installed in a machinery chamber provided in the lower portion of the refrigerator.

Figure 5:
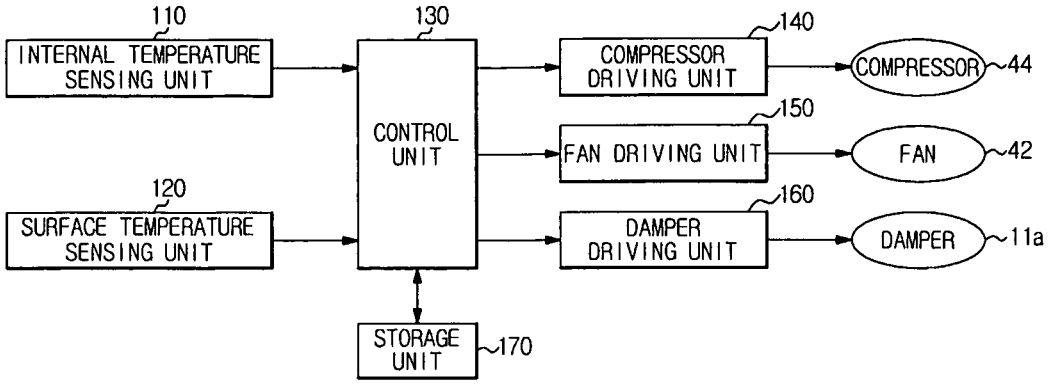
FIG. 5 is a control block diagram of the refrigerating apparatus in accordance with the embodiment.

FIG. 5 is a control block diagram of the refrigerating apparatus in accordance with the embodiment. The refrigerating apparatus includes an internal temperature sensing unit 110, a surface temperature sensing unit 120, a control unit 130, a compressor driving unit 140, a fan driving unit 150, a damper driving unit 160, and a storage unit 170.

The internal temperature sensing unit 110 senses a temperature in the freezing chamber 10 and transfers the sensed temperature in the freezing chamber 10 to the control unit 130, and the surface temperature sensing unit 120 senses a surface temperature of a stored article and transfers the sensed surface temperature of the stored article to the control unit 130. Here, an infrared sensor may be used as the surface temperature sensing unit 120.

The control unit 130 controls refrigerating units, i.e., the compressor driving unit 140, the fan driving unit 150, and the damper driving unit 160, such that the temperature of the freezing chamber 10 is maintained within a freezing point temperature zone, based on the temperature in the freezing chamber 10 transferred from the internal temperature sensing unit 110 when the stored article is frozen. The central unit 130 also compares the surface temperature of the stored article with the temperature of a freezing point, and counts a time, for which the surface temperature of the stored article is maintained within the freezing point temperature zone, when the surface temperature of the stored article is within the freezing point temperature zone, and determines whether or not the counted time reaches a first designated time. Here, the first designated time is a time to determine temperature stabilization of the stored article in that the surface temperature of the stored articles is stabilized in the freezing point temperature zone.

Further, the control unit 130 controls the refrigerating units, i.e., the compressor driving unit 140, the fan driving unit 150, and the damper driving unit 160, for a second designated time such that the temperature in the freezing chamber 10 is maintained at a freezing temperature below the freezing point, when the counted time is the first designated time or. The central unit 130 also controls the refrigerating unit, i.e., the compressor driving unit 140, the fan driving unit 150, and the damper driving unit 160, such that the temperature in the freezing chamber 10 is maintained at a preserving temperature to preserve the frozen state of the stored article, when the second designated time has passed.

The control unit 130 increases the number of rotations of the fan 42 by the fan driving unit 150 and the number of the opened dampers 11*a* to 11*d* by the damper driving unit 160, when the control unit 130 controls the refrigerating units to maintain the temperature in the freezing chamber 10 at the freezing temperature below the freezing point, thus allowing a larger amount of cold air to be supplied to the freezing chamber 10.

Here, the temperature of the freezing point is about 0° C., the freezing temperature below the freezing point is −20° C. to −30° C., the preserving temperature is −18° C. or less, and the freezing point temperature zone is in a temperature range of a deviation of −1° C. from the temperature of the freezing point.

Further, the control unit 130 may determine whether or not both the temperature in the freezing chamber 10 and the surface temperature of the stored article are maintained within the freezing point temperature zone for the first designated time or larger, and control the refrigerating units 140, 150, and 160 such that the temperature in the freezing chamber 10 is maintained at the freezing temperature below the freezing point, when it is determined that the two temperatures are maintained within the freezing point temperature zone for the first designated time or longer.

The compressor driving unit 140 drives the compressor 44 according to instructions of the control unit 130, and compresses the refrigerant into a high-temperature and high-pressure state, thereby causing the temperature in the freezing chamber 10 to be maintained at the temperature of the freezing point, the freezing temperature below the freezing point, or the preserving temperature. Here, when the compressor 44 is switched on, the compressor 44 compresses the refrigerant, and supplies the compressed refrigerant to the evaporator 41 through the condenser (not shown).

The fan driving unit 150 rotates the fan 42 at a speed corresponding to instructions of the control unit 130, thereby sucking air of the freezing chamber 10 and discharging cold air having heat-exchanged with the evaporator 41 to the freezing chamber 10 through the discharge holes h2. Here, the fan driving unit 150 increases the number of rotations of the fan 42 when the temperature in the freezing chamber 10 is maintained at the freezing temperature below the freezing point, as opposed to when the temperature in the freezing chamber 10 is maintained within the freezing point temperature zone.

The damper driving unit 160 selectively opens and closes the dampers 11*a* to 11*d* installed on the respective wall surfaces of the freezing chamber 10 according to instructions of the control unit 130. Here, the damper driving unit 160 increases the number of the opened dampers 11*a* to 11*d* when the temperature in the freezing chamber 10 is maintained at the freezing temperature below the freezing point, as opposed to when the temperature in the freezing chamber 10 is maintained within the freezing point temperature zone.

The storage unit 170 stores the first designated time when the freezing chamber and the stored article is maintained at the temperature of the freezing point, the second designated time when the stored article is maintained at the freezing temperature below the freezing point, the temperature of the freezing point, the temperature below the freezing point, and the preserving temperature.

Figure 6:
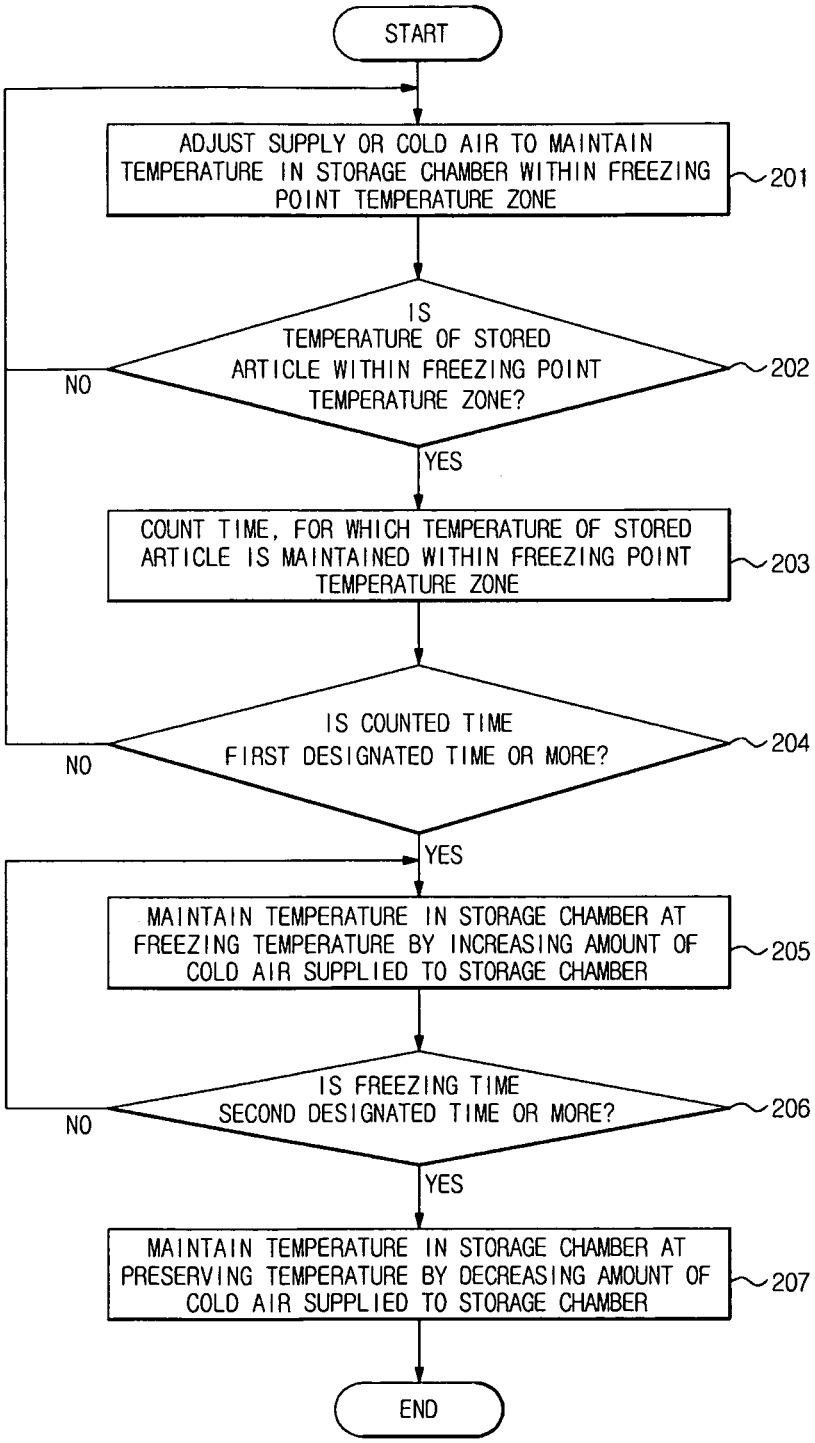
FIG. 6 is a flow chart illustrating a method of controlling the refrigerating apparatus in accordance with the embodiment.

FIG. 6 is a flow chart illustrating a method of controlling the refrigerating apparatus in accordance with this embodiment to improve freezing quality of a stored article. The method of FIG. 6 will be described with reference to FIGS. 3, 4 and 5, and FIGS. 7A and 7B.

Figure 7A:
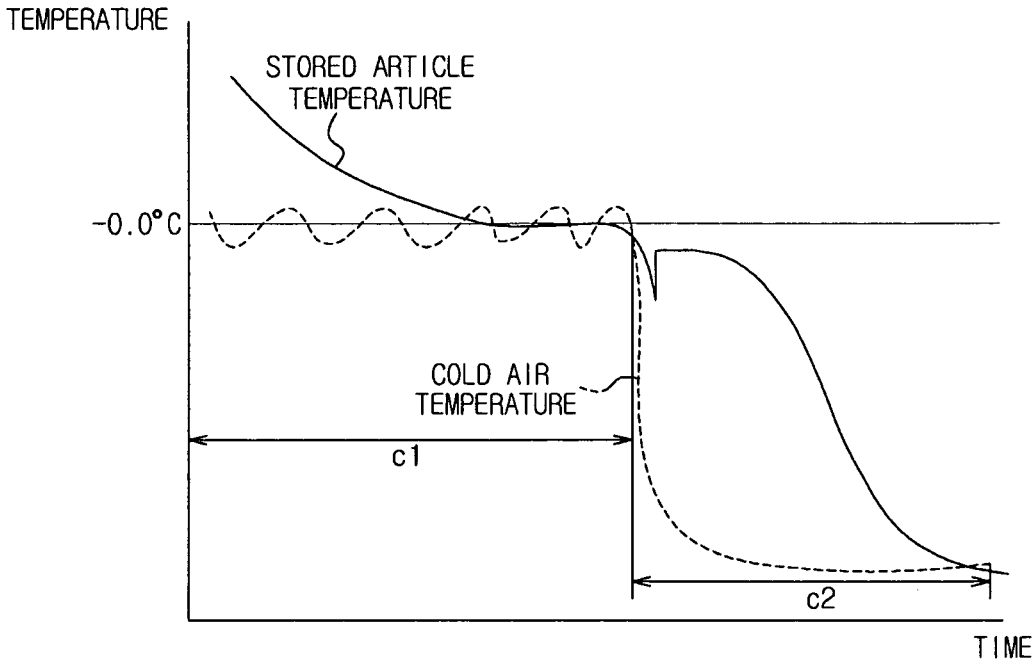
FIGS. 7A and 7B are graphs illustrating an internal temperature and variations in temperatures of a storage chamber and a stored article according to time in the refrigerating apparatus in accordance with the embodiment.
Figure 7B:
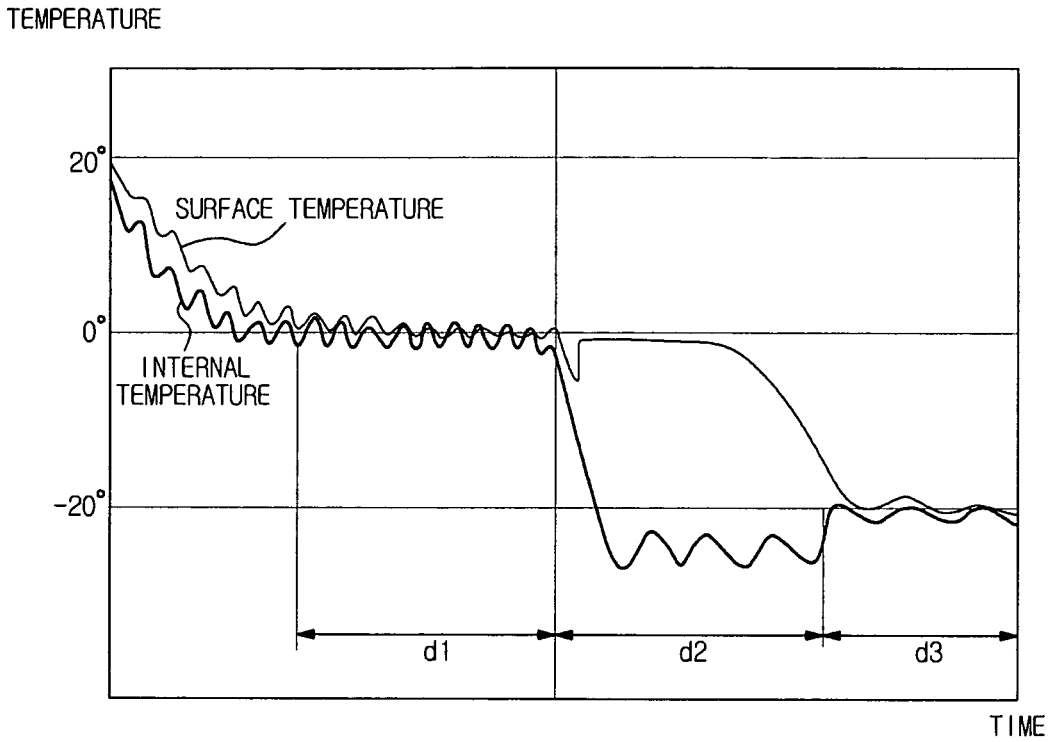

FIGS. 7A and 7B are graphs illustrating control of refrigeration of the refrigerating apparatus in accordance with the embodiment. Particularly, FIG. 7A is a graph illustrating control of an internal temperature of the freezing chamber, and FIG. 7B is a graph illustrating a variation in the internal temperature of the freezing chamber and a variation in the surface temperature of a stored article.

When a user instructs freezing of an article, the internal temperature sensing unit 110 senses a temperature in the freezing chamber 10, and driving of the refrigerating units 140, 150, and 160 is controlled according to the sensed temperature of the freezing chamber 10 to adjust the amount of cold air supplied to the freezing chamber 10, thereby maintaining the temperature in the freezing chamber 10 within the freezing point temperature zone (operation 201).

Here, since the temperature of the article stored in the freezing chamber 10 differs from the temperature in the freezing chamber 10, heat transfer between the stored article and the inside of the freezing chamber 10 occurs, and thereby the temperature in the freezing chamber 10 is continuously varied.

Therefore, the amount of the cold air supplied to the freezing chamber 10 is adjusted based on the temperature in the freezing chamber 10 for a time c1 from a point of time when freezing of the stored article is started to the time when the surface temperature of the stored article is maintained within the freezing point temperature zone, as shown in FIG. 7A. This allows the temperature in the freezing chamber 10 to be maintained within the freezing point temperature zone.

By the control of the driving of the refrigerating units, as described above, the temperature in the freezing chamber 10 is maintained within the freezing point temperature zone, and thereby the temperature of the stored article starts to be lowered to the freezing point temperature zone d1, as shown in FIG. 7B.

The temperature of the stored article starts to be lowered from the surface of the stored article to the center of the stored article. As heat of the center of the stored article is discharged to the outside through the surface of the stored article, the surface temperature of the stored article is continuously varied. Further, when even the center of the stored article is refrigerated to the freezing point temperature zone, the temperature of the stored article and the temperature in the freezing chamber 10 become equal and thus the surface temperature of the stored article and the temperature in the freezing chamber 10 are not varied. That is, when the center as well as the surface of the stored article is refrigerated to the freezing point temperature zone, the surface temperature of the stored article is not varied and is maintained within the freezing point temperature zone.

In order to determine whether or not the center as well as the surface of the stored article is refrigerated to the freezing point temperature zone, the surface temperature of the stored article is sensed by the surface temperature sensing unit 120, and the frozen state of the stored article is determined based on the sensed surface temperature. That is, the surface temperature of the stored article is compared with the temperature of the freezing point (operation 202), and when it is determined that the surface temperature of the stored article reaches the freezing point temperature zone, a time, for which the surface temperature of the stored article is maintained within the freezing point temperature zone, is counted (operation 203). Then the counted maintenance time is compared with the first designated time (operation 204). When the counted maintenance time is the first designated time or longer, it is determined that the surface temperature of the stored article is stabilized in the freezing point temperature zone.

Thereafter, the amount of the cold air supplied to the freezing chamber 10 is increased by driving the refrigerating units, i.e., the compressor driving unit 140, the fan driving unit 150, and the damper driving unit 160, as shown in FIG. 7A, thus rapidly lowering the temperature in the freezing chamber 10 for a time c2. As the temperature in the freezing chamber 10 is rapidly lowered, phase change of the stored article instantaneously occurs, and thereby the stored article starts to freeze.

That is, the temperature in the freezing chamber 10 is lowered to the freezing temperature below the freezing point, and then the lowered temperature in the freezing chamber 10 is maintained for the second designated time d2, thereby freezing the stored article (operation 205).

Since the temperature in the freezing chamber 10 is varied according to the temperature of the stored article, it may be possible to determine whether or not both the temperature in the freezing chamber 10 and the surface temperature of the stored article are maintained within the freezing point temperature zone and then maintain the temperature in the freezing chamber 10 at the freezing temperature below the freezing point.

The freezing of the stored article due to the maintenance of the temperature of the freezing chamber 10 at the freezing temperature for the second designated time d2 may be achieved by sensing the surface temperature of the stored article and controlling the sensed surface temperature of the stored article for a time to stabilize the surface temperature of the stored article at the freezing temperature.

If the stored article is stabilized in the freezing point temperature zone, as described above, the stored article is easily super-cooled, and thus when the stored article is cooled to the temperature below the freezing point, super-cooling of the stored article occurs within a short time and then is terminated, and freezing of the stored article begins.

Thereafter, it is determined whether or not the second designated time to freeze the stored article has passed (operation 206). When it is determined that the second designated time has passed, the amount of the cold air supplied to the freezing chamber 10 is decreased by driving the refrigerating units, i.e., the compressor driving unit 140, the fan driving unit 150, and the damper driving unit 160, thus maintaining the temperature in the freezing chamber 10 within a preserving temperature zone. That is, the temperature in the freezing chamber 10 is maintained within the preserving temperature zone (operation 207), thereby allowing the frozen article to be stored at the preserving temperature for a preservation time d3.

As described above, if the surface temperature and the center temperature of the stored article are cooled close to the freezing point, the stored article is frozen for a short time using super-cooling, and thus the surface and the center of the stored article start to freeze simultaneously, and destruction of cells of the stored article is suppressed. Further, when the stored article is frozen, the stored article passes a maximum ice crystal formation zone uniformly and rapidly. This will be described with reference to FIG. 8.

Figure 8:
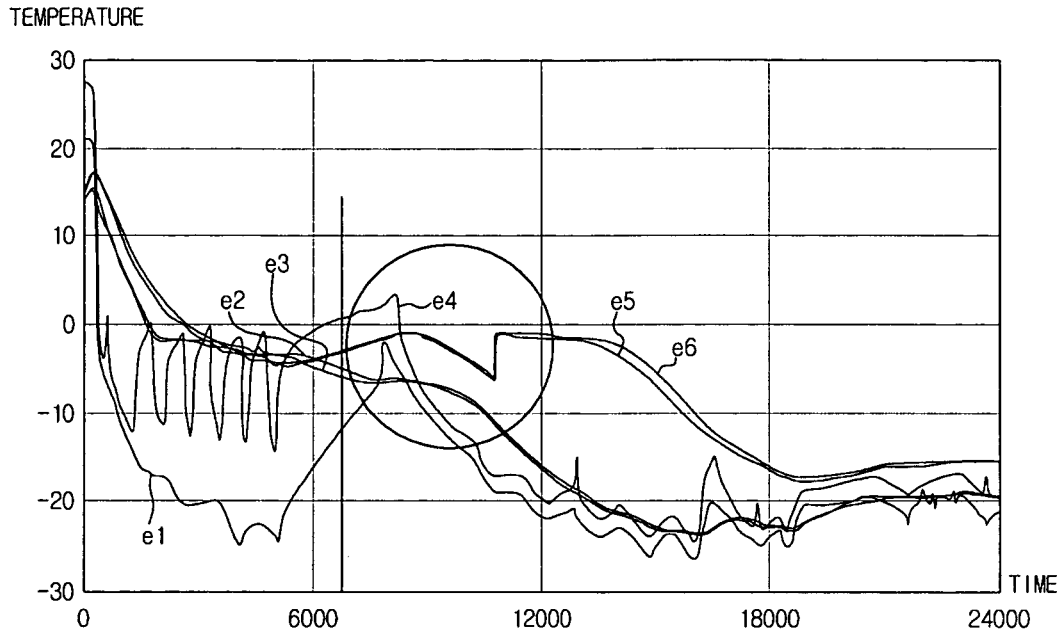
FIG. 8 is a graph illustrating variations in temperatures of two stored articles according to time, when two refrigerating cycles are carried out, in the refrigerating apparatus in accordance with the embodiment.

FIG. 8 is a graph illustrating variations in temperatures of surfaces and centers of stored articles according to time, when the stored articles cooled to the freezing point temperature zone are frozen using different refrigerating cycles, in the refrigerating apparatus in accordance with the embodiment.

More specifically, in FIG. 8, e1 is a temperature control curve of a freezing chamber, in which a refrigerating cycle to cool a temperature in the freezing chamber to about −20° C. is carried out, e2 is a surface temperature variation curve of a stored article in the freezing chamber, and e3 is a center temperature variation curve of the stored article in the freezing chamber. Further, in FIG. 8, e4 is a temperature control curve of a freezing chamber, in which a second refrigerating cycle using super-cooling is carried out, e5 is a surface temperature variation curve of a stored article in the freezing chamber, and e6 is a center temperature variation curve of the stored article in the freezing chamber.

When the temperatures of the freezing chambers are varied after the stored articles in the freezing chambers are respectively frozen by the two refrigerating cycles under the condition that both the centers and the surfaces of the stored articles are maintained within the freezing point temperature zone, as described above, the super-cooling of both stored articles is terminated within a short time and then the stored articles are frozen. Therefore, small ice crystals, which are uniformly distributed, are formed in the stored articles, and thus quality of the stored articles is improved.

Figure 9:
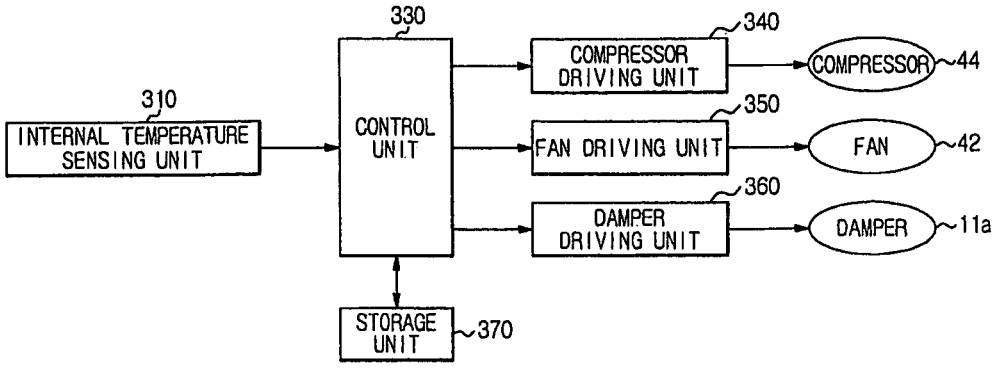
FIG. 9 is a control block diagram of a refrigerating apparatus in accordance with another embodiment.

FIG. 9 is a control block diagram of a refrigerating apparatus in accordance with another embodiment. The refrigerating apparatus in accordance with this embodiment includes an internal temperature sensing unit 310, a control unit 330, a compressor driving unit 340, a fan driving unit 350, a damper driving unit 360, and a storage unit 370. The construction and operation of the refrigerating apparatus in this embodiment are substantially the same as those of the refrigerating apparatus in the embodiment shown in FIGS. 3 and 4, and thus will be described with reference to FIGS. 3 and 4.

The internal temperature sensing unit 310 senses a temperature in the freezing chamber 10 and transfers the sensed temperature in the freezing chamber 10 to the control unit 330.

The control unit 330 controls refrigerating units, i.e., the compressor driving unit 340, the fan driving unit 350, and the damper driving unit 360, for a first designated time such that the temperature of the freezing chamber 10 is maintained within a freezing point temperature zone, based on the temperature in the freezing chamber 10 transferred from the internal temperature sensing unit 310 in a freezing mode, controls the refrigerating units, i.e., the compressor driving unit 340, the fan driving unit 350, and the damper driving unit 360, for a second designated time such that the temperature of the freezing chamber 10 is maintained at the freezing temperature below the freezing point, when the first designated time has passed, and controls the refrigerating units, i.e., the compressor driving unit 340, the fan driving unit 350, and the damper driving unit 360, such that the temperature of the freezing chamber 10 is maintained at the preserving temperature, when the second designated time has passed.

The control unit 330 increases the number of rotations of the fan 42 by the fan driving unit 350 and the number of the opened dampers 11*a* to 11*d* by the damper driving unit 360, when the control unit 330 controls the refrigerating units to maintain the temperature in the freezing chamber 10 at the freezing temperature below the freezing point. This is opposed to when the control unit 330 controls the refrigerating units to maintain the temperature in the freezing chamber 10 within the freezing point temperature zone. Thus a larger amount of cold air can be supplied to the freezing chamber 10.

Here, the temperature of the freezing point is about 0° C., the freezing point temperature zone is in a temperature range of a deviation of −1° C. from the freezing point, the freezing temperature below the freezing point is −20° C. to −30° C., and the preserving temperature is −18° C. or less.

The compressor driving unit 340 drives the compressor 44 according to instructions of the control unit 330, and compresses the refrigerant into a high-temperature and high-pressure state, thereby causing the temperature in the freezing chamber 10 to be maintained at the temperature of the freezing point, the freezing temperature below the freezing point, or the preserving temperature.

The fan driving unit 350 rotates the fan 42 at a speed corresponding to instructions of the control unit 330, thereby sucking air of the freezing chamber 10 and discharging cold air having heat-exchanged with the evaporator 41 to the freezing chamber 10 through the discharge holes h2. Here, the fan driving unit 350 increases the number of rotations of the fan 42 when the temperature in the freezing chamber 10 is maintained at the freezing temperature below the freezing point rather than when the temperature in the freezing chamber 10 is maintained within the freezing point temperature zone.

The damper driving unit 360 selectively opens and closes the dampers 11*a* to 11*d* installed on the respective wall surfaces of the freezing chamber 10 according to instructions of the control unit 330. Here, the damper driving unit 360 increases the number of the opened dampers 11*a* to 11*d* when the temperature in the freezing chamber 10 is maintained at the freezing temperature below the freezing point rather than when the temperature in the freezing chamber 10 is maintained within the freezing point temperature zone.

The storage unit 370 stores the first designated time when the freezing chamber 10 is maintained at the temperature of the freezing point, the second designated time when the freezing chamber 10 is maintained at the freezing temperature below the freezing point, the temperature of the freezing point, the temperature below the freezing point, and the preserving temperature.

Here, the first designated time is a predetermined time, which is set in advance according to testing, to determine that the center surface of then article stored in the freezing chamber 10 is within the freezing point temperature zone. The second designated time is a predetermined time, which is set in advance according to testing, to complete freezing of the article stored in the freezing chamber 10.

In the test to set the first designated time, various amounts and thicknesses of articles were prepared in consideration of influence of the amount and thickness of an article on the first designated time, and then times to cool center temperatures of the respective articles to the temperature of the freezing point were measured. Among the respective times, the maximum time was set to the first designated time. This will be described with reference to FIG. 10.

Figure 10:
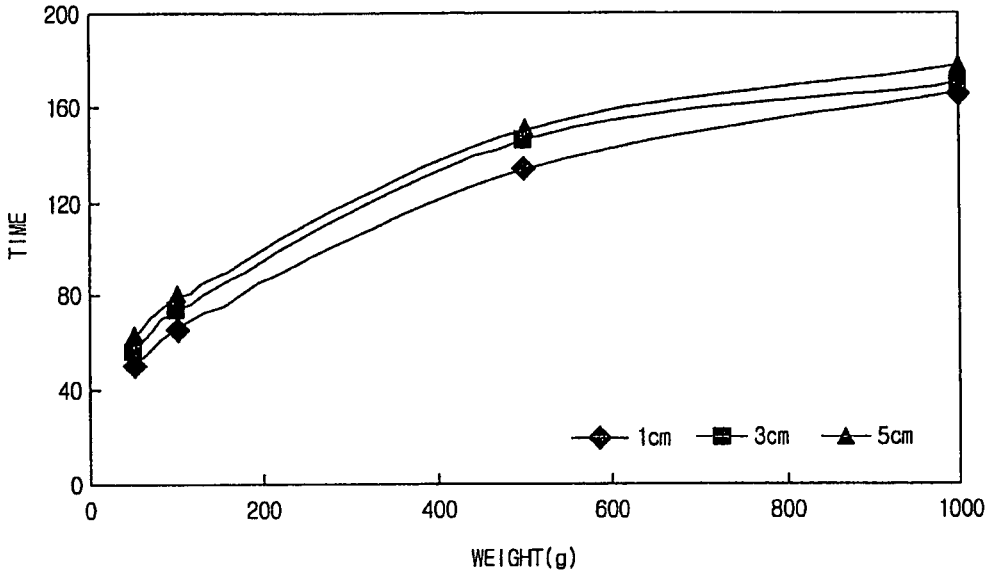
FIG. 10 is a graph illustrating a stabilization time test of the refrigerating apparatus in accordance with the embodiment.

FIG. 10 is a graph illustrating a test to set a time to cool articles to the freezing point temperature zone in the refrigerating apparatus in accordance with this embodiment. In this test, various amounts and thicknesses of articles were prepared, and then times to cool the center temperatures of the respective articles to the freezing point temperature zone were measured. Among the respective times, the maximum time was set to the first designated time. Here, the maximum time among the times to maintain the articles at the freezing point temperature zone was about 180 minutes, and the amounts of the articles are varied up to the maximum consumption amount (1,000 g) one time. Further, the first designated time may be adjusted by a user corresponding to the amount of the article to be stored in the freezing chamber 10.

Figure 11:
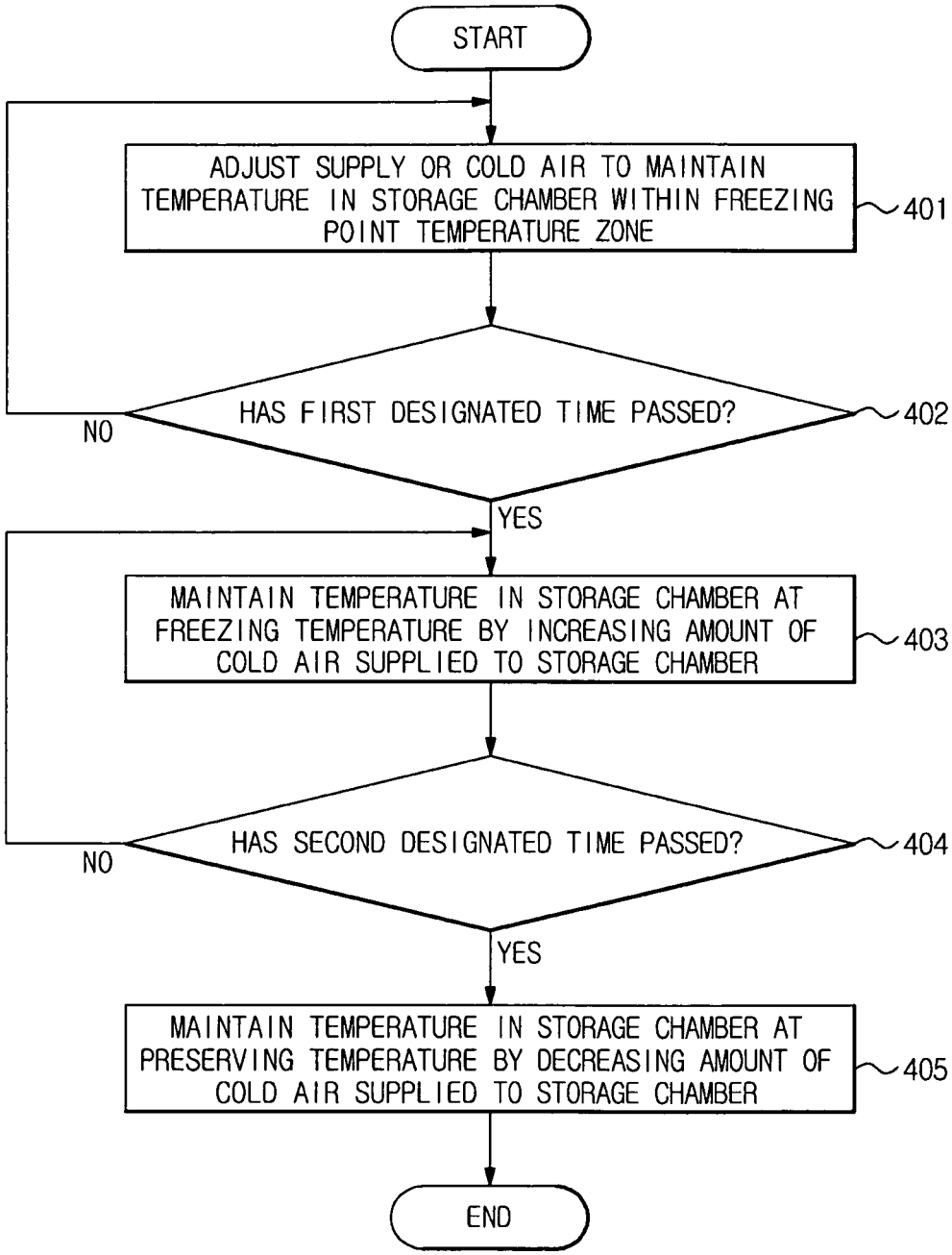
FIG. 11 is a flow chart illustrating a method of controlling the refrigerating apparatus in accordance with the embodiment.

FIG. 11 is a flow chart illustrating a method of controlling the refrigerating apparatus in accordance with this embodiment to improve freezing quality of stored articles respectively collected in plural containers. The method of FIG. 11 will be described with reference to FIGS. 3, 4 and 9.

When a user selects freezing of the stored articles, the internal temperature sensing unit 310 senses a temperature in the freezing chamber 10, and driving of the refrigerating units 340, 350, and 360 is controlled according to the sensed temperature of the freezing chamber 10, thereby maintaining the temperature in the freezing chamber 10 within the freezing point temperature zone for the first designated time (operation 401). Here, since the articles stored in the freezing chamber 10 emit heat, the temperature in the freezing chamber 10 is continuously varied. Therefore, the temperature in the freezing chamber 10 is maintained within the freezing point temperature zone by continuously sensing the temperature in the freezing chamber 10 and controlling the refrigerating units 340, 350, and 360 based on the sensed temperature in the freezing chamber 10.

Here, the first designated time is a predetermined time, which is set in advance by a test, to determine that the center surface of articles stored in the freezing chamber 10 is within the freezing point temperature zone.

Thereafter, when the first designated time has passed (operation 402), the amount of the cold air supplied to the freezing chamber 10 is increased by driving the refrigerating units, i.e., the compressor driving unit 340, the fan driving unit 350, and the damper driving unit 360, thus maintaining the temperature in the freezing chamber 10 at the freezing temperature below the freezing point for the designated time (operation 403). Thereby, the stored articles are maintained at the freezing temperature below the freezing point, and begin to freeze.

Besides, it may be possible to control the refrigerant units 340, 350, and 360 such that the temperature in the freezing chamber 10 is maintained at the freezing temperature below the freezing point, by counting a time, for which the temperature in the freezing chamber 10 is maintained within the freezing point temperature zone, and then comparing the counted maintenance time with a predetermined time. Here, the time, for which the temperature in the freezing chamber 10 is maintained within the freezing point temperature zone, is a time to maintain the freezing chamber within the freezing point temperature zone when cold air is not supplied to the freezing chamber 10.

As the temperature in the freezing chamber 10 is rapidly lowered, phase change of the stored articles instantaneously occurs, and thereby the stored articles start to freeze.

If the stored articles are maintained within the freezing point temperature zone and thus are stabilized, as described above, the stored articles are easily super-cooled. That is, when the temperature in the freezing chamber 10 is changed from the temperature of the freezing point to the freezing temperature below the freezing point, super-cooling of the stored articles occurs within a short time and then is terminated, and the stored articles to freeze.

Thereafter, it is determined whether or not the second designated time has passed (operation 404). When it is determined that the second designated time has passed, the amount of the cold air supplied to the freezing chamber 10 is decreased by driving the refrigerating units, i.e., the compressor driving unit 340, the fan driving unit 350, and the damper driving unit 360, thus maintaining the temperature in the freezing chamber 10 within a preserving temperature zone (operation 405). That is, the frozen articles in the freezing chamber 10 are preserved at the preserving temperature.

As described above, if the surface temperature and the center temperature of the stored articles are cooled close to the freezing point and are then cooled again to the freezing temperature below the freezing point, super-cooling of the stored articles is carried out for a short time, the surfaces and the centers of the stored articles start to freeze simultaneously, and thus destruction of cells of the stored articles is suppressed.

Further, the temperature of the freezing point is a temperature, at which the articles are not frozen even when the amount of the articles is large. If a plurality of articles or a large amount of an article is stored in the freezing chamber 10, when only the first designated time to stabilize the article(s) is extended, the plural articles are stabilized within the freezing point temperature zone and start to freeze simultaneously, and thus the plural articles pass a maximum ice crystal formation zone uniformly and rapidly. Therefore, small ice crystals, which are uniformly distributed, are formed in the stored articles, and thus quality of all the plural articles is improved.

Although a few embodiments have been shown and described, it would be appreciated by those skilled in the art that changes may be made in these embodiments without departing from the principles and spirit of the embodiments, the scope of which is defined in the claims and their equivalents.

What is claimed is:

1. A method of controlling a refrigerating apparatus, the method comprising:

controlling a temperature in a storage chamber of the refrigerating apparatus to a freezing point temperature zone in a super cooling state by adjusting cold air supplied to the storage chamber;

determining whether a temperature of articles stored in the storage chamber is stabilized in the freezing point temperature zone; and controlling the temperature in the storage chamber to a temperature below a freezing point by increasing an amount of the cold air supplied to the storage chamber when it is determined that the temperature of articles stored in the storage chamber is stabilized in the freezing point temperature zone by the cold air, wherein the determining of whether the temperature of articles stored in the storage chamber is stabilized in the freezing point temperature zone comprises determining whether a temperature of a surface of the stored articles is equal to a temperature of the storage chamber, and wherein the controlling of the temperature in the storage chamber to the temperature below the freezing point comprises performing a super-cooling process, and lowering the temperature of the storage chamber to the temperature below the freezing point to cancel the super-cooling state, so that the surface of the stored articles and the core of the stored articles are simultaneously frozen.

2. The method according to claim 1, wherein the determining whether the temperature of the articles stored in the storage chamber is stabilized in the freezing point temperature zone includes determining whether or not the temperature in the storage chamber is maintained within the freezing point temperature zone for a designated time.

3. The method according to claim 1, wherein the increasing the amount of the cold air includes adjusting at least one of an amount of the cold air and a direction of the cold air supplied to the storage chamber.

4. The method according to claim 1, wherein the controlling of the temperature in the storage chamber to the temperature below the freezing point generates phase change of the stored articles stabilized in the freezing point temperature zone to freeze the stored articles.

5. The method according to claim 4, further comprising maintaining the temperature in the storage chamber at a preserving temperature comprising decreasing the amount of the cold air supplied to the storage chamber when the freezing of stored articles is completed.

6. The method according to claim 5, wherein the preserving temperature is a temperature between the temperature of the freezing point and a temperature below the freezing point.

7. A method of controlling a refrigerating apparatus comprising:

maintaining a temperature in a storage chamber at a freezing point temperature zone for a first designated time by supplying cold air to the storage chamber such that a temperature of articles stored in the freezing chamber is in a super cooling state in the freezing point temperature zone; and maintaining the temperature in the storage chamber at a temperature below a freezing point for a second designated time by adjusting the cold air when the first designated time has passed, wherein the maintaining the temperature in the storage chamber at the freezing point temperature zone comprises determining whether a temperature of a surface of the stored articles is equal to a temperature of the storage chamber; and wherein the maintaining of the temperature in the storage chamber to the temperature below the freezing point comprises performing a super-cooling process, and when a first designated time has passed, lowering the temperature of the storage chamber to the temperature below the freezing point to cancel the super-cooling, so that the surface of the stored articles and the core of the stored articles are simultaneously frozen.

8. The method according to claim 7, wherein:

the first designated time is a time to cool centers as well as surfaces of the articles stored in the storage chamber to the temperature of the freezing point; and the second designated time is a time to freeze the stored articles.

9. The method according to claim 7, further comprising maintaining the temperature in the storage chamber at a preserving temperature comprising adjusting the cold air when the second designated time has passed.

10. The method according to claim 7, wherein the adjusting of the cold air includes adjusting at least one of an amount of the cold air and a direction of the cold air supplied to the storage chamber.

11. The method according to claim 7, wherein the temperature below the freezing point is a temperature at which phase change of the stored articles occurs.

12. A method of controlling a refrigerating apparatus, comprising:

controlling a temperature in a storage chamber to a freezing point temperature zone in a super cooling state by supplying cold air to the storage chamber;

sensing a temperature of articles stored in the storage chamber;

determining whether or not the temperature of the stored articles is maintained within the freezing point temperature zone by determining whether a temperature of a surface of the stored articles is equal to a temperature of the storage chamber; and when it is determined that the temperature of the stored articles is maintained within the freezing point temperature zone, lowering the temperature in the storage chamber to a temperature below a freezing point by adjusting the cold air so as to cancel the super cooling state, so that the surface of the stored articles and a core of the stored articles are simultaneously frozen.

13. The method according to claim 12, wherein the determining as to whether or not the temperature of the stored articles is maintained within the freezing point temperature zone includes:

sensing the temperature in the storage chamber; and determining whether or not the temperature in the storage chamber is maintained within the freezing point temperature zone.

14. The method according to claim 12, further comprising determining whether or not the temperature of the stored articles is maintained within the freezing point temperature zone for a designated time.

15. A refrigerating apparatus comprising:

a storage chamber to store articles;

an internal temperature sensing unit to sense a temperature in the storage chamber;

a plurality of refrigerating units to adjust cold air supplied to the storage chamber; and a control unit configured to control a temperature in the storage chamber to a freezing point temperature zone in a super cooling state by controlling the refrigerating units, to determine whether the temperature of the articles stored in the storage chamber are maintained within the freezing point temperature zone, and to lower the temperature in the storage chamber to a temperature below a freezing point to cancel the super cooling state when a temperature of articles stored in the storage chamber are maintained within the freezing point temperature zone, so that a surface of the stored articles and a core of the stored articles are simultaneously frozen.

16. The refrigerating apparatus according to claim 15, wherein the control unit maintains the temperature in the storage chamber within the freezing point temperature zone for a designated time.

17. The refrigerating apparatus according to claim 15, further comprising a surface temperature sensing unit to sense a surface temperature of the stored articles, wherein the control unit determines whether or not the temperature in the storage chamber and the surface temperature of the stored articles are maintained within the freezing point temperature zone in the controlling of the temperature in the storage chamber to the freezing point temperature zone.

18. The refrigerating apparatus according to claim 15, wherein the refrigerating units include:

a plurality of dampers formed on respective wall surfaces of the storage chamber to open and close discharge holes, through which the cold air is discharged; and a fan to adjust a supply amount of the cold air.

19. The refrigerating apparatus according to claim 15, wherein the temperature below the freezing point is a temperature at which phase change of the stored articles occurs.

20. The refrigerating apparatus according to claim 15, wherein the control unit controls the refrigerating units to maintain the storage chamber at a preserving temperature when the freezing of stored articles is completed.

* * * * *